US005800273A

United States Patent [19]

Potocki

[11] Patent Number: 5,800,273

[45] Date of Patent: Sep. 1, 1998

[54] METHOD AND APPARATUS FOR PLAYING A POCKET BILLIARD GAME

[76] Inventor: John Potocki, 1 Beam Ave., Jackson, N.J. 08527

[21] Appl. No.: 926,215

[22] Filed: Sep. 9, 1997

[51] Int. Cl.[6] ..... A63B 15/00

[52] U.S. Cl. ..... 473/1

[58] Field of Search ..... 473/1

[56] References Cited

U.S. PATENT DOCUMENTS

| | | | |
|---|---|---|---|
| 4,183,523 | 1/1980 | Hecht | 473/1 |
| 4,307,881 | 12/1981 | Jaworski | 473/1 |
| 4,452,450 | 6/1984 | Cayton | 473/1 |
| 4,768,781 | 9/1988 | McMillin | 473/1 |
| 5,350,171 | 9/1994 | Woziak | 473/1 |

*Primary Examiner*—Theatrice Brown
*Attorney, Agent, or Firm*—Clifford G. Frayne

[57] ABSTRACT

A kit for playing a pocket billiards game and method for playing a pocket billiards game utilizing seven object balls and a cue ball, the seven object balls comprised of three object balls having a first indicia, three object balls having a second indicia, and a single object ball having a third indicia, the overall object of the billiard game being for a player to pocket a billiard ball having a first or second indicia on one side of the table and thereafter pocket the remaining object balls having the same indicia on the same side of the table followed by the pocketing of the object ball having the third indicia on the same side of the table, the play alternating between a second player or a second team of players, the winning player or team being the one which first pockets the object ball having the third indicia on the players or teams designated side of the table.

11 Claims, 2 Drawing Sheets

METHOD AND APPARATUS FOR PLAYING A POCKET BILLIARD GAME

BACKGROUND OF THE INVENTION

1. Field of the Invention

This invention relates to a pocket billiard game played on a conventional table with a novel set of object balls and rules.

2. Description of the Prior Art

Pocket billiards is conventionally played on a generally rectangular table having a playing surface twice as long as it is wide. Six pockets are provided, one at each of the corners of the rectangle and one at each center of the two longitudinal sides or rails of the table. There are many popular games played on such a pocket billiards table which vary in the number of balls utilized. The balls, identical in diameter and small enough to be able to enter the pockets smoothly are utilized as targets. In general, one ball, commonly white and known as the cue ball is propelled by being struck by an instrument known as a cue stick. The usual object of a pocket billiards game is to cause the cue ball to contact one or more other balls known as the object balls and further cause one or more of the object balls to enter the pockets.

A conventional billiards game consists of fifteen (15) object balls initially racked triangularly and positioned on an indicia on the foot end of the table. The triangular rack is removed and the cue ball is struck from the opposite end of the table, the head area, to break the triangular configuration of the object balls. The fifteen object balls comprise a solid black number eight ball and seven balls of solid colors and seven balls of striped configuration. In the known game of 8 Ball a player who pockets the first ball, be it a solid ball or a striped configuration ball, must then sink all of the similarly configured balls and conclude by sinking the eight ball. Certain variations of this game are known to those of ordinary skill in the art.

Another configuration is commonly referred to as Nine Ball. In this configuration, only nine balls are used and racked in a diamond configuration. Still further, the game of Snooker is also well-known in the art which utilizes a larger table with twenty-one (21) object balls.

It will be recognized by those familiar with billiards that there are many variations of games that can be played with a fifteen object ball rack or with the nine object ball rack.

Applicant's invention relates to a fast moving competitive game utilizing seven object balls with a novel methodology for scoring. The essence of Applicant's game, as will be more fully described hereafter, utilizes seven object balls, three of the object balls having the same indicia, three other object balls having a different indicia, and the seventh object ball having a third indicia. The balls are racked so as the ball having the third indicia is in the center of the rack alternately surrounded by the six object balls having the other two indicia. The object of the game is to break the racked arrangement of object balls and either sink the object ball having the third indicia off the break, and if not, play would continue as follows: If a player pocketed an object ball having a first indicia on one side of the table, those object balls having that indicia become that player's object balls and the side of the table in which the object ball was pocketed becomes that player's side of the table. The object balls having a different indicia and the opposite side of the table would belong to the second player. The object of the game is for each player to sink their respective object balls on their respective side of the table and then call and pocket the object ball having the third indicia on one of the pockets on the player's side of the table.

The numerous billiard games heretofore known all have different approaches and strategies. This game is called Star Ball due to the indicia on the seventh object ball and there are various methods and strategies that can used while playing this game, therefore making the game more interesting to play than some of the other known games.

In Star Ball, because of the variety of options for the players, you are not limited to only shooting at the lowest numbered ball on the table. This game has less competitive draw backs that other billiard games. There are specific balls for use for Star Ball, along with other markers that gives the game an aesthetic quality that no other billiard game has heretofore illustrated.

Further, every game is different depending on the strategy used by the players. Some games can end quickly and other games can last for a long period of time depending upon the strategies. A match is scored in sets of games instead of individual games which also heightens the competitiveness and suspense of the game. A match consists of the best of five sets. Each set consists of the best of three games.

The game of Star Ball is designed so that it is simple enough for a novice to play and enjoy, but is also challenging and strategic enough for a professional player with a higher degree of skill to enjoy as well. The methodology of the game is such that the chance of a run out on one turn is not as likely as in some other billiard games. To do so in Star Ball would require the proper positioning of the cue ball on every shot. However, players have many options they could take on any shot that may change the outcome of the game. The strategic options make the game of Star Ball highly compelling and interesting. Some of these options include positioning of opposing player's balls blocking the pockets of your opponent or positioning the winning object ball away from an opponent who would have an easy pocketing shot lined up. There are many more strategies that can be utilized and these are only illustrative of a few of such strategies. Further, Star Ball has a unique system for penalties. When a scratch of the cue ball occurs, a player has a choice of setting the cue ball on either end of the table, not just one end. This provides an interesting difference in the gme of billiards and keeps the game from becoming too difficult.

Except for the specific rules relating to Star Ball, the game incorporates the same standardized rules pertaining to the general play of any game of billiards. Therefore, in situations not covered by the specific rules of Star Ball, the general rules of pocket billiards will apply. The application of fouls and regulations would be set at the discretion of the official as for instance, the type of cues to be used, the size of the table, touching or moving of a ball with the hand, the keeping of at least one foot on the floor while shooting, and jumping over balls in play with the cue ball, etc. Any published official billiard rule book could be utilized for these instances, such as in the case that this game may be judged by an official as a spectator tournament event.

OBJECTS OF THE INVENTION

An object of the present invention is to provide for a novel billiard game which is faster, and more competitive than billiard games heretofore known.

A still further object of the present invention is to provide for a novel billiard game having a unique methodology for scoring.

It is a still further object of the present invention to provide for a novel billiard game utilizing a unique combination of object balls and a unique arrangement of racking the object balls for play.

It is a still further object of the present invention to provide for a novel billiard game which provides for the utilization of strategies not heretofore required or utilized in billiard games heretofore known.

SUMMARY OF THE INVENTION

A pocket billiard game played on a conventional pocket billiard table with ordinary cue sticks and cue ball, but whose object ball set is composed of seven balls, three balls having a first indicia, three balls having a second indicia, and the seventh ball having a third indicia, the game consisting of racking all seven balls and performing a break shot. The object of the game is for a player to pocket all three balls of either the first indicia of the second indicia in the pockets formed on one side of the table and to follow the pocketing of the three indicia balls by pocketing the ball of the third indicia in the designated pockets on the player's side of the table. The opposing player will alternatively attempt to pocket the three balls of the remaining indicia on the opposing side of the table followed by the ball of the third indicia. The first player to pocket the ball of the third indicia in the proper pocket is the winner. Balls illegally pocketed or scratched shots result in the return to the table of a previously pocketed ball or the presentation of a marker requiring the next pocketed ball to be returned to the table.

DETAILED DESCRIPTION OF THE DRAWINGS

Figure 1:
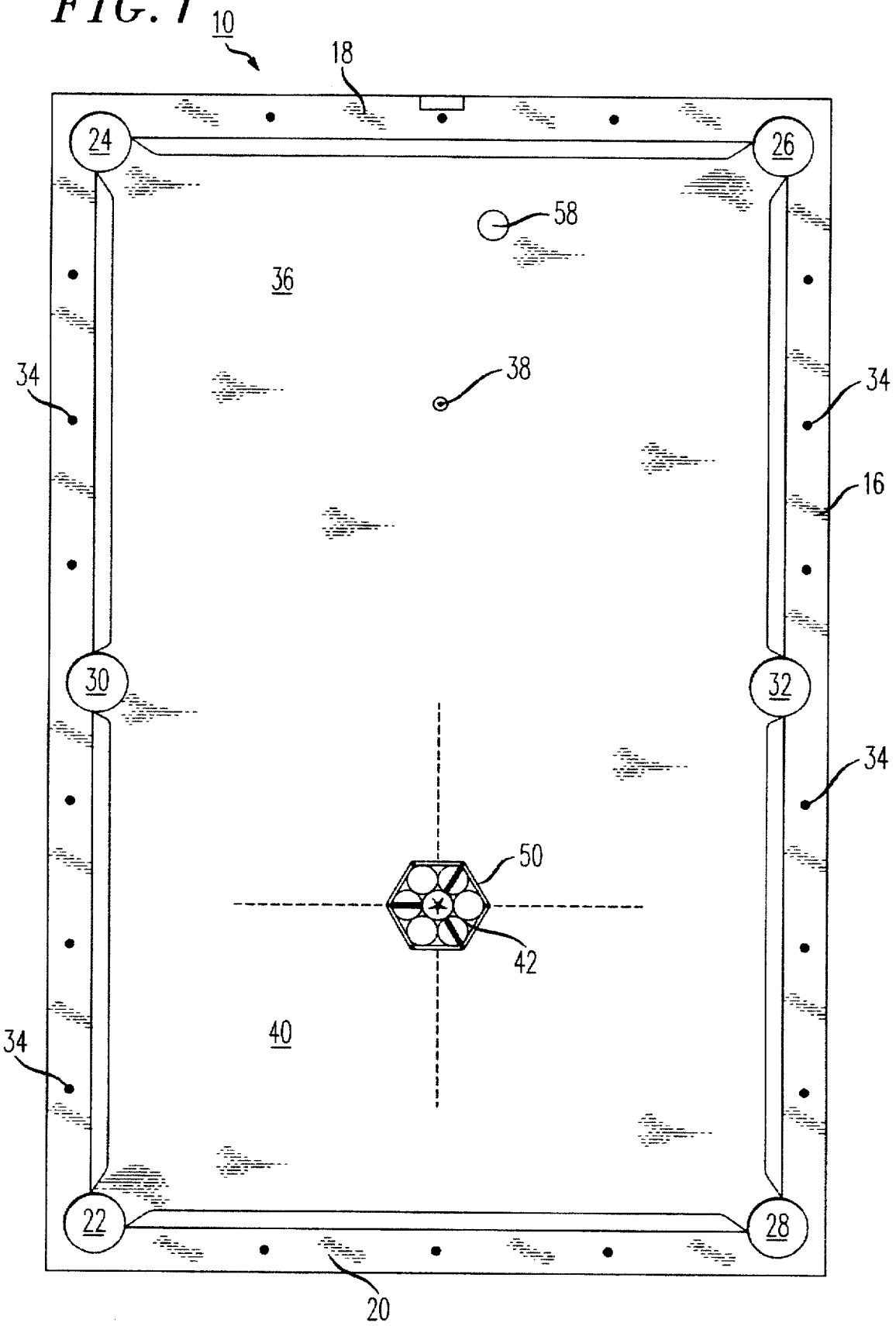
FIG. 1 is a top view of a conventional billiard table illustrating the elements of the billiard table and the positioning of the object balls and the cue balls for the start of the game.

Referring to FIG. 1 there is illustrated a top view of a billiard table illustrating the positioning of the racked object balls and the cue ball. The billiard table 10 is generally rectangular in nature having a playing surface 12 normally and conventionally covered with felt, a first side rail 14, a second side rail 16, a transverse rail 18 commonly referred to as the head rail of the table, and a second transverse rail 20 commonly referred to as the foot rail of the table.

The billiard table has positioned at the respective corners, pockets 22, 24, 26, and 28 and pockets 30 and 32 positioned at the midpoint of side rails 14 and 16. These pockets are sized for the receipt of object balls as more fully described hereafter. In addition, a conventional billiard table will have a plurality of indicia positioned on side rails 14 and 16 and on the transverse rails comprising the head of the table and the foot of the table 18 and 20. These indicia 34 are normally diamond-shaped and three indicia are positioned on the transverse head rail 18 and three indicia are positioned on the transverse foot rail 20, equally spaced apart between pockets 24 and 26 and pockets 22 and 28 respectively. Additionally, three indicia 34 are positioned on a side rail 14 between pocket 22 and 30 in equal increments and between pocket 30 and pocket 24 in equal increments. The same indicia and spacing are also found on side rail 16. The indicia 34 serve to divide the playing surface 12 of billiard table 10 into certain designated areas as will be more clear as explained hereafter.

The head area 36 of the table is defined as that area between the transverse head rail 18 and an imaginary head string line extending from the middle indicia 34 on transverse rail 14 between pockets 30 and 24 and the middle indicia 34 on longitudinal rail 16 between pockets 32 and 26. The head spot 38 is defined as the intersection of the aforesaid imaginary head string and an imaginary center string extending from the middle indicia 34 on transverse head rail 18 to the middle indicia 34 on transverse foot rail 20.

The foot area 40 is similarly defined as the area extending from transverse foot rail 20 to an imaginary foot string extending between the middle indicia 34 on longitudinal rail 14 between pocket 30 and pocket 22 and the middle indicia 34 on second longitudinal rail 16 between pocket 32 and 28. This imaginary foot string line is commonly referred to as the object line.

The foot spot 42 is defined as the intersection of the imaginary foot string and the intersection of the imaginary center string extending from the middle indicia 34 on transverse head rail 18 to the middle indicia 34 on transverse foot rail 20.

Figure 2:
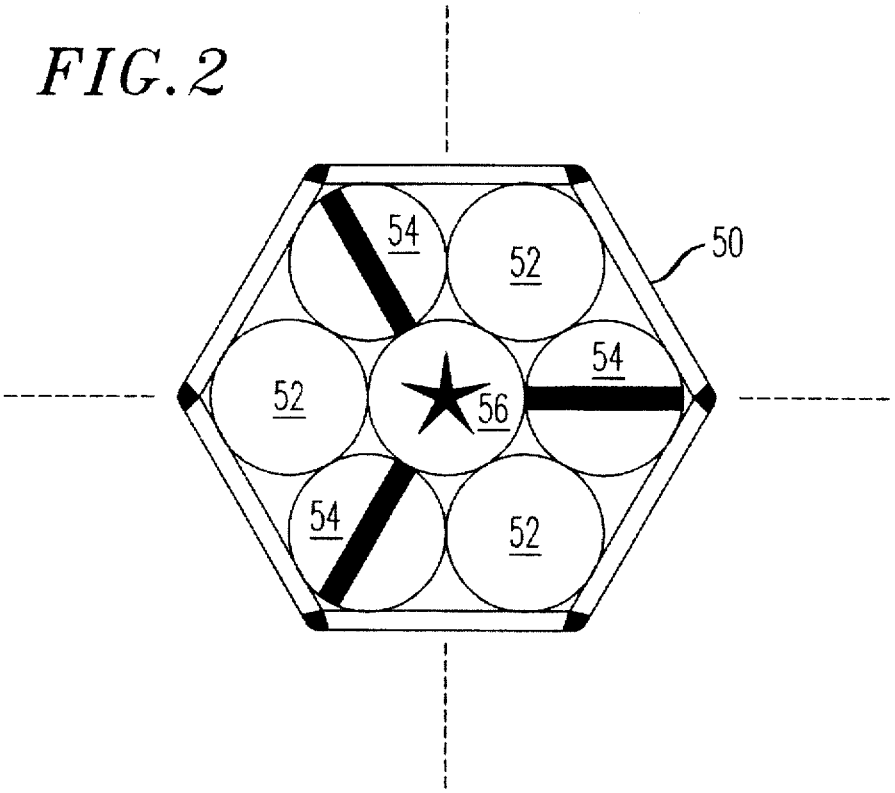
FIG. 2 is a top view of the preferred embodiment of the set of object balls used in conjunction with the present invention.

FIG. 1 illustrates the positioning of a hexagonal rack 50 about the foot spot 42 which encloses 7 object balls as more detailed in FIG. 2.

FIG. 2 is a top view of rack 50 enclosing the object balls in a configuration in which the central object ball is positioned on the foot spot and surrounded by six object balls who are in tangential contact with the surface of the middle object ball and the surface of each adjacent object ball. The object balls are positioned such that the center object ball and two adjacent object balls are positioned on the axis of the imaginary object line, thereby presenting an apex of two object balls of different species as described hereafter.

The object balls of the game comprise three separate species. The first set of object balls 52 comprises three object balls all having the same indicia on their surface. In the embodiment illustrated in FIG. 2, the object balls 52 would be of the same solid color. A second set of object balls 54 would have a separate indicia from object balls 52. In the configuration illustrated in FIG. 2, the second set of object balls 54 are striped. The third set of object balls 56 comprises a single object ball having a separate indicia from object balls 52 and 54. In this embodiment, object ball 56 has a plurality of star indicia and it is object ball 56 which is positioned on the foot spot 42 of surface 12 of billiard table 10. Object balls 52 and 54 are alternately arranged about object ball 56. The game derives its name from the indicia on object ball 56.

Referring back to FIG. 1, the object balls are shown in position at the foot spot 42 and the cue ball 58 is illustrated as being in the head area 36 of surface 12 of billiard table 10.

The game is designed for two players or four players playing as two player teams and the choice of who goes first is determined by lagging the cue ball from the head area to the transverse foot rail 20 and back into the head area attempting to come as close as possible to transverse head rail 18, or by the flip of a coin or other similar chance device. Thereafter, the loser of the previous game would break the rack arrangement. To commence the game, the player would position the cue ball in the head area 36 of surface 12, strike the cue ball with the cue stick (not shown) and cause the cue ball 58 to strike the object balls and scatter them about the table. The methodology of the game develops from the result of the break. The object of the game is for Player A to pocket the three object balls 52 having the first indicia or the three object balls 54 having a secondary indicia into the player's designated pockets and to follow the three object balls with the star ball into the player's designated pockets. Player B would attempt to pocket the remaining set of object balls, either 52 or 54 into Player B's designated pockets followed by the star ball 56. The player's designated pockets consist of either pockets 22, 30 and 24 or 28, 32 and 26. Thus one player is attempting to pocket one set of three object balls having the same indicia and the star ball 56 into pockets associated with one longitudinal rail while the opposing player attempts to pocket the remaining set of three object balls having a second indicia into the pockets associated with the opposing longitudinal rail followed by the star ball 56. To legally win game, the star ball 56 must enter pocket without touching an opponent's ball and without scratching cue ball, or the player will lose.

The play of the game proceeds as follows once the two players determine who is going to break the rack.

The first player would strike the cue ball from the head area 36 of the table into the rack of object balls. If the object ball, star ball 56 is pocketed off of the break, the player automatically wins the game, as long as a scratch or pocketing of the cue ball does not occur. If the player does not pocket the object ball 56, but rather, pockets an object ball 52 or 54, the first such ball which is pocketed becomes the player's object ball and the side of the table in which the object ball is pocketed becomes the player's side of the table. The player would then proceed to attempt to pocket a similar object ball on the same side of the table utilizing the cue ball. When first player fails to sink a similar object ball on the player's side of the table, the turn would pass to the second player. Then the players would alternate in attempting to sink their respective object balls on their respective sides of the table. If no ball is pocketed on the break, the second player proceeds to attempt to sink a selected object ball on one side of the table. Balls are neutral until designated and a player can use combinations with any ball until player's balls and sides are designated. If successful, then the object ball 52 or 54 which the player has pocketed will become that player's object ball and the side of the table on which it was pocketed will become the player's side of the table. Play would alternate between players in this manner.

A player continues to shoot as long as a designated object ball is pocketed on the correct side of the table. It is unnecessary for a player to call his shot or pocket until the player is shooting for the star ball 56. At that time, the player must specify which pocket the star ball will enter before the shot is taken, wrong pocket loses.

A player may also attempt a safety shot at any time during play. The safety shot requires the cue ball to strike any ball on the table directly without hitting a rail first including the object ball having the third indicia, and the first ball contacted must contact a rail of the table. This shot, a safety, can be used for reasons of either offense or defense. The failure of the first ball contacted to strike a rail results in a failed safety. If player contacts a rail first with cue ball when attempting a safety shot, it is a failed safety.

The cue ball during play, must strike a player's own object ball first, including combination shots in order for an object ball subsequently pocketed to be considered legally pocketed. If a player strikes an opponents object ball first and then pockets his own object ball, even if on the correct side, the player's object ball pocketed is returned to the table and the play reverts to the other player, unless balls are neutral before they are designated. At this time a combination shot is allowed using any balls. Any ball which is returned to the table is returned to the foot point 42 of the table. Any time a player pockets an opponents ball anywhere on the table, the ball is considered pocketed and is not returned to the table. If a player pockets his object ball on the opponent's side of the table, the ball returns to the table and is positioned at the foot point 42.

If a player pockets an object ball correctly and it is followed by another object ball being pocketed, if the second object ball is pocketed on the correct side, both balls stay in and play continues with the player continuing to shoot. If the second ball is pocketed on the opponent's side, the first ball stays in, but the second ball returns to the foot point 42 and the player relinquishes his turn. If the cue ball scratches as well, then both balls are returned to the table at the foot point 42 regardless of where they were pocketed. If a player pockets one of his object balls on the wrong side of the table and scratches (pockets) the cue ball, the player owes two balls to the foot point, one for the object ball in the wrong pocket and one for the scratch. As long as a player strikes a designated object ball first, the ball is allowed to carom off other balls and rails and if it finds a pocket on the player's side of the table, play continues.

When balls are returned to the table, if a ball already occupies the foot point 42, the balls are then placed in a direct line behind the foot point 42 space.

Figure 3A:
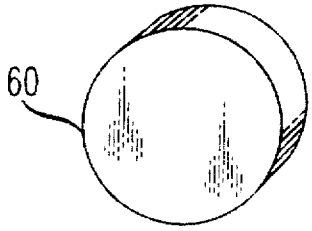
FIG. 3A, 3B, and 3C are prospective views of markers positioned on the rails of the billiard table and used during the play of the game.
Figure 3B:
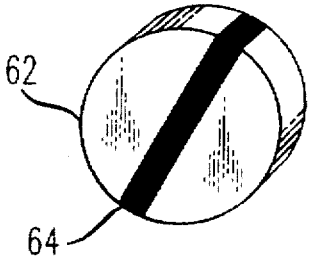
Figure 3C:
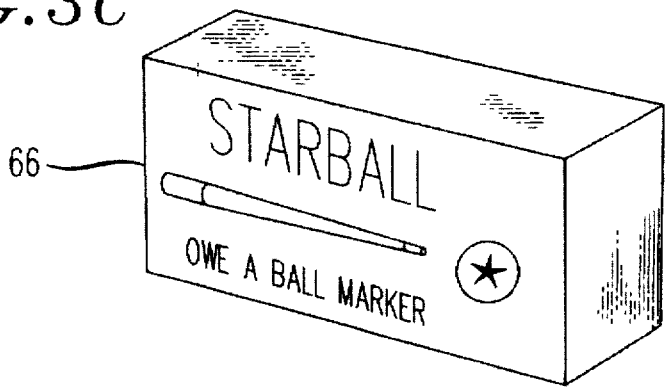

FIGS. 3A, 3B and 3C are prospective views of additional markers utilized in the playing of the game. FIG. 3A is a side marker 60 which is circular in shape and corresponds to the object balls 52 having a first indicia, namely a solid color which color would be the same as marker 60. FIG. 3B illustrates a circular marker having the same indicia as the second set object balls 54 having a second indicia which in the embodiment and exemplars discussed herein, would be a striped indicia. Therefore the marker 62 as illustrated in FIG. 3B would have the same color stripe 64 as the second set of object balls 54 having a second indicia.

FIG. 3C illustrates a second marker 66 which is generally rectangular in shape. Marker 66 has its own indicia or wording and in the exemplar illustrated in FIG. 3C, identifies itself as a "Owe a Ball Marker". This marker is placed on the respective player's side of the table if the player has played a shot which requires a penalty of placing an object ball at the foot spot 42 and the player has not yet pocketed an object ball. Hence the "Owe a Ball Marker" 66 would be placed on the player's side of the table indicating that the next legally pocketed object ball would be removed and placed at the foot spot 42. There would be several "Owe a Ball Markers" associated with the game since it is conceivable that a player could commit an infraction which would result in more than one ball being required to be removed after pocketing and placed on the foot spot 42. These markers do not carry over to following games and are removed at the end of a game.

Whenever a player commits a scratch of the cue ball, the player owes one of their object balls to the table at the foot point 42. The opposing player then has a choice of placing the cue ball behind the imaginary object line in the object area 36 of the table surface 12, or the foot area 40, and contact any ball that is forward of these imaginary lines. If an object ball is pocketed when the scratch occurs it is returned to the table at the foot point 42. If two object balls were pocketed when the scratch occured, only one of them is returned to the table at the foot point 42. If an opponents ball is pocketed when a scratch occurs, the opponent gets credit for the pocketed ball and it remains pocketed. The player commiting the scratch owes one of their object balls to the foot point 42. If a scratch occurs without pocketing any object balls a previously pocketed object ball goes to the foot point 42. If a player commits a scratch and has not pocketed any designated object balls, the player receives the "Owe a Ball Marker" and it is placed on the respective player's side of the table and as soon as an object ball is pocketed by the player, it is returned to the table at the foot point 42. The marker is then removed and the player is allowed to continue to shoot.

A safety shot becomes a failed safety shot when the first ball contacted by the cue ball fails to reach a rail, or no balls are contacted at all, or if a rail is contacted first by the cue ball which then strikes an object ball which does not reach a pocket or a rail, or if a rail is contacted first by the cue ball and then an opponents ball is struck. In these instances, the opponent has the option of shooting the cue ball from where it has come to rest, or to place the cue ball behind the imaginary object line in the head zone 36 of the table surface 12 and shoot at any balls that are forward of the imaginary object line.

In summary, the player loses his turn if no balls are contacted on the table or any type of scratch of the cue ball occurs, or the opponent pockets the other opponents ball, a failed safety is committed or an object ball is pocketed on the wrong side of the table.

While the present invention has been described with respect to the preferred embodiment of the invention for the purposes of disclosure, it will be recognized by those of ordinary skill in the art that many modifications or changes can be made without departing from the spirit and scope of the invention as defined by the Claims appended hereto.

While the present invention has been described in connection with an exemplary embodiment thereof, it will be understood that many modifications will be apparent to those of ordinary skill in the art, and that this application is intended to cover any adaptations or variations thereof. Therefore, it is manifestly intended that this invention by only limited by the Claims and the equivalence thereof.

What is claimed:

1. An apparatus kit for playing a pocket billiards game with a cue ball on a pocket billiard table having pockets, comprising:

a set of seven object balls, three of said object balls having a first indicia, three of said object balls having a second indicia and one of said object balls having a third indicia;

a hexagonal racking tray for racking said object balls, said object ball having said third indicia positioned in the center of said racking tray and said object balls having said first indicia and said second indicia alternately arranged about said object ball having said third indicia;

a pair of markers positionable on a side rail of said pocket billiard table to identify a player's side of the table, each of said markers having an indicia identical to the indicia on said three object balls having a first indicia or said three object balls having a second indicia; and a plurality of second markers having a distinct indicia for identifying the number of object balls pocketed which must be returned to the table.

2. The apparatus in accordance with claim 1 wherein said three object balls having a first indicia have a first indicia comprising a solid coloring.

3. The apparatus in accordance with claim 1 wherein said three object balls having a second indicia having a second indicia comprising a striped coloring.

4. The apparatus in accordance with claim 1 wherein said three object balls having a second indicia have a second indicia comprising a solid coloring distinct from said coloring of said three object balls having a first indicia.

5. The apparatus in accordance with claim 1 wherein said object ball having a third indicia has an indicia comprising a five pointed star.

6. The apparatus in accordance with claim 1 wherein said object ball having a third indicia has an indicia comprising a plurality of five point stars.

7. A method of playing a pocket billiards game for two players or two teams with a cue ball on a pocket billiard table having pockets, comprising:

(a) providing a collection of seven object balls, three of said object balls having a first indicia, three of said object balls having a second indicia and one of said object balls having a third indicia;

(b) arranging said object balls in a predetermined configuration upon the table, said object ball having a third indicia positioned in the center of said arrangement and said three object balls having a first indicia and said three object balls having a second indicia arranged about said object ball having a third indicia in alternating positions thus forming a hexagon;

(c) using the movement of said cue ball to strike said arrangement of said object balls thus breaking said arrangement;

(d) using the movement of said cue ball to strike an object ball having either a first indicia or a second indicia and pocketing said object ball thereby determining a player's side of the table and said player's object balls;

(e) continuing to use the movement of said cue ball to strike said designated object balls until said player fails to pocket one of said designated object balls;

(f) alternating play to a second player using the movement of the cue ball to strike an object ball having the remaining first or second indicia and attempting to pocket said object ball on said second player's side of the table (g) alternating play until one player has pocketed all of said player's object balls;

(h) using the movement of the cue ball to strike the object ball having a third indicia and pocketing said object ball having a third indicia on said player's side of the table after all of said player's object balls have been pocketed.

8. The method in accordance with claim 7 wherein said player repeats steps d and e until said player fails to strike said player's object ball and pocket said player's object ball.

9. The method in accordance with claim 7 wherein said player continues to repeat steps d and e until said player fails to strike said object ball with said cue ball.

10. A method in accordance with claim 7 wherein said player continues to repeat steps d and e until said player illegally pockets said cue ball.

11. The method as defined in claim 7 wherein said method comprises the further steps of:

providing a set of rules defining when an object ball has been legally pocketed by a player and when an object ball has been illegally pocketed by a player and any corresponding relief to said player for the pocketing of said object ball.

* * * * *